US007889032B2

(12) United States Patent
Parker et al.

(10) Patent No.: US 7,889,032 B2
(45) Date of Patent: Feb. 15, 2011

(54) ELECTROMAGNETIC RELAY

(75) Inventors: David Glen Parker, Trinity, NC (US); Victor Eugene Slack, Lewisville, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 267 days.

(21) Appl. No.: 12/174,265

(22) Filed: Jul. 16, 2008

(65) Prior Publication Data

US 2010/0013580 A1 Jan. 21, 2010

(51) Int. Cl.
*H01H 51/22* (2006.01)

(52) U.S. Cl. ..... 335/78; 335/128

(58) Field of Classification Search ..... 335/78–86, 335/124, 128–135

See application file for complete search history.

(56) References Cited

U.S. PATENT DOCUMENTS

| | | | | |
|---|---|---|---|---|
| 3,165,607 | A | 1/1965 | Hogan | |
| 3,614,684 | A | 10/1971 | Egler | |
| 3,925,742 | A | 12/1975 | Muench | |
| 4,097,832 | A | 6/1978 | Ritzenthaler et al. | |
| 4,181,907 | A | 1/1980 | Esposito et al. | |
| 4,220,937 | A | 9/1980 | Ritzenthaler | |
| 5,227,750 | A | 7/1993 | Connell et al. | |
| 5,332,986 | A | 7/1994 | Wieloch | |
| 5,394,127 | A | 2/1995 | Hendel | |
| 5,694,099 | A | 12/1997 | Connell et al. | |
| 5,952,904 | A | 9/1999 | Doneghue | |
| 6,020,801 | A | 2/2000 | Passow | |
| 6,084,756 | A | 7/2000 | Doring et al. | |
| 6,426,689 | B1 | 7/2002 | Nakagawa | |
| 6,724,604 | B2 | 4/2004 | Shea | |
| 6,816,048 | B2 | 11/2004 | Morita et al. | |
| 7,161,104 | B2 | 1/2007 | Bergh et al. | |
| 7,642,884 | B2 * | 1/2010 | Bergh et al. | 335/78 |
| 7,710,224 | B2 * | 5/2010 | Gruner et al. | 335/78 |
| 2002/0036557 | A1 * | 3/2002 | Nakamura et al. | 335/128 |
| 2003/0112103 | A1 | 6/2003 | Schmelz | |
| 2004/0263293 | A1 * | 12/2004 | Saruwatari et al. | 335/128 |
| 2006/0279384 | A1 * | 12/2006 | Takayama et al. | 335/78 |

FOREIGN PATENT DOCUMENTS

| | | |
|---|---|---|
| DE | 10 2006 015251 | 4/2007 |
| DE | 11 2005 000053 | 5/2007 |
| DE | 10 2006 015815 | 9/2007 |

OTHER PUBLICATIONS

International Search Report, International Application No. PCT/US2009/004071, International Filing Date, Jul. 14, 2009.

* cited by examiner

*Primary Examiner*—Anh T Mai
*Assistant Examiner*—Bernard Rojas

(57) ABSTRACT

An electromagnetic relay includes a relay coil assembly, an armature, and a contact system. The contact system includes a stationary contact assembly stationary contacts and moveable contact springs adjacent to the stationary contacts. The moveable contact springs have a projecting portion. The armature is pivotably actuated in response to an electromagnetic force generated by the relay coil to move the at least one contact spring linearly between a first position and a second position. The stationary contact assembly includes an overmold portion attached to the at least one stationary contact. The overmold portion includes a dielectric material and is bonded to the at least one stationary contact to maintain a predetermined configuration of the stationary contact relative to the at least one moveable contact spring.

18 Claims, 5 Drawing Sheets

ELECTROMAGNETIC RELAY

The present invention is directed to an electromagnetic relay, and more particularly to an electromagnetic latching relay for motor protection.

BACKGROUND

A relay is an electromagnetically actuated, electrical switch. Conventional relays include stationary contacts and moving contacts corresponding with the stationary contacts. When the relay is electromagnetically actuated, the moving contacts engage or disengage with the stationary contacts, to respectively close or open an electrical circuit. We modified the numbering scheme here.

A latching relay can have one or two coils. Latching relays have no FCOILdefault position, so they maintain their last position or state when magnetizing current is interrupted. While the relays themselves may be latching, their reset position in a module is based on the control circuitry and software Latching relays may be used to reduce power consumption and dissipation because once actuated, latching relays require no current to maintain their position. In one-coil latching, the direction of current determines the relay position. In two-coil latching, the coil which is energized determines the position of the armature.

A latching magnetic relay assembly typically includes a relay motor assembly that is magnetically coupled to an actuation assembly. The actuation assembly is then operatively coupled to a contact spring that is positioned opposite a pair of conductively isolated contact points. The relay motor typically drives the actuation assembly, which in turn drives the contact spring into contact with a pair of contact points positioned directly across from the spring. The conductive springs ensure good contact with the contact points, and they form a conductive pathway between the contact points. Conductive springs are typically made of copper or a copper alloy.

Other latching relays may include electromagnets for generating a magnetic field that intermittently opposes a field generated by a permanent magnet. Although this is a bi-stable type of latching relay, such a relay requires consumption of power in the electromagnet to maintain at least one of the output states. Moreover, the power required to generate the opposing field may be significant, thus making the relay unsuitable for use in space, portable electronics, and other applications that demand low power consumption.

Another bi-stable, latching type relay operates using a magnet to generate a magnetic field to induce a magnetization in a cantilever. The magnetization suitably creates a torque on the cantilever that forces cantilever toward or away from contacts, depending upon the direction of the magnetization, thus placing the relay into an open or closed state. The direction of magnetization in the cantilever may be adjusted by a second magnetic field. The second magnetic field may be generated through an electromagnet, or by passing a current through conductor. The second magnetic field may be applied in "pulses" or otherwise intermittently as required to switch the relay.

Other concerns with existing latching or non-latching relays include stationary terminals that are inserted manually into a plastic frame during assembly of the relay. The stationary terminals may not be placed uniformly, making a manual adjustment necessary during assembly, and the terminals may eventually move out of position later. In others, there may be inconsistent and variable contact force and ampere levels due to uneven adjustment of the contact springs. Finally, long contact fingers for stationary relay contacts are difficult to insert into a small space and must be manually interlaced between many parts, in a tedious and time consuming manner.

What is needed is a relay that includes a stationary contact frame assembly that provides shortened relay contacts that do not require interlacing between parts or manual adjustment during manufacturing.

SUMMARY OF THE INVENTION

In one embodiment, the invention is directed to an electromagnetic latching relay. The latching relay includes a relay coil assembly, an armature, and a contact system. The contact system includes a stationary contact assembly stationary contacts and moveable contact springs adjacent to the stationary contacts. The moveable contact springs have a projecting portion. The armature is pivotably actuated in response to an electromagnetic force generated by the relay coil to move the at least one contact spring linearly between a first position and a second position. The at least one stationary contact assembly includes an overmold portion attached to the at least one stationary contact. The overmold portion includes a dielectric material and is bonded to the at least one stationary contact to maintain a predetermined configuration of the stationary contact relative to the at least one moveable contact spring.

In another embodiment, the invention is directed to a stationary contact assembly for a relay. The contact assembly includes one or more stationary contacts, and an overmold portion attached to the stationary contacts. The overmold portion includes a dielectric material and is bonded to the at least one stationary contact to maintain a predetermined configuration of the stationary contact relative to at least one moveable contact spring.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
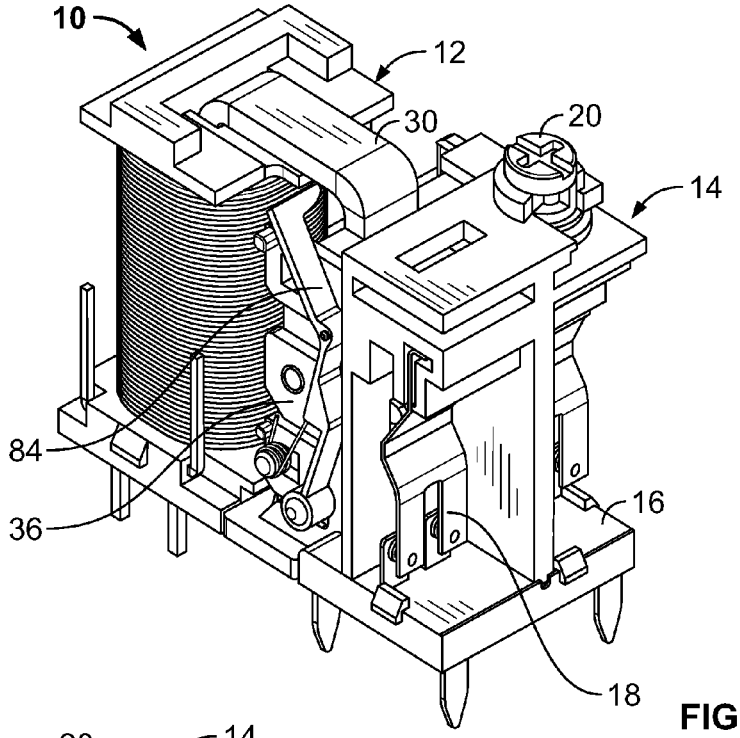
FIG. 1 is a perspective view of a latching relay in accordance with the present invention.
Figure 2:
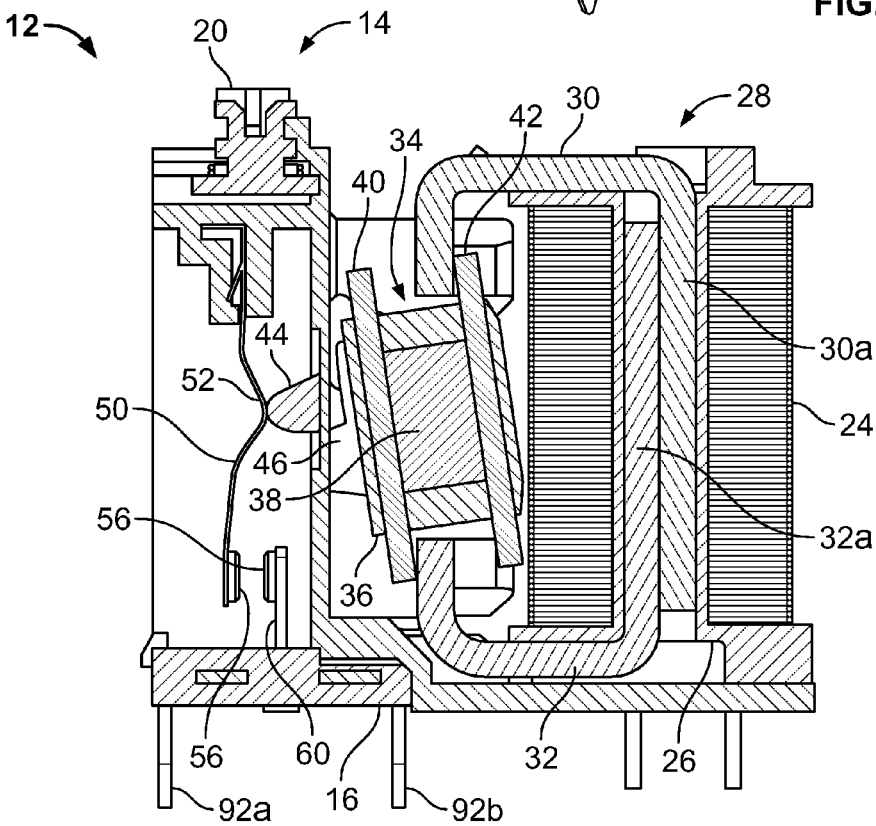
FIG. 2 is a cross-sectional view of the latching relay taken along lines A-A in FIG. 1.
Figure 3:
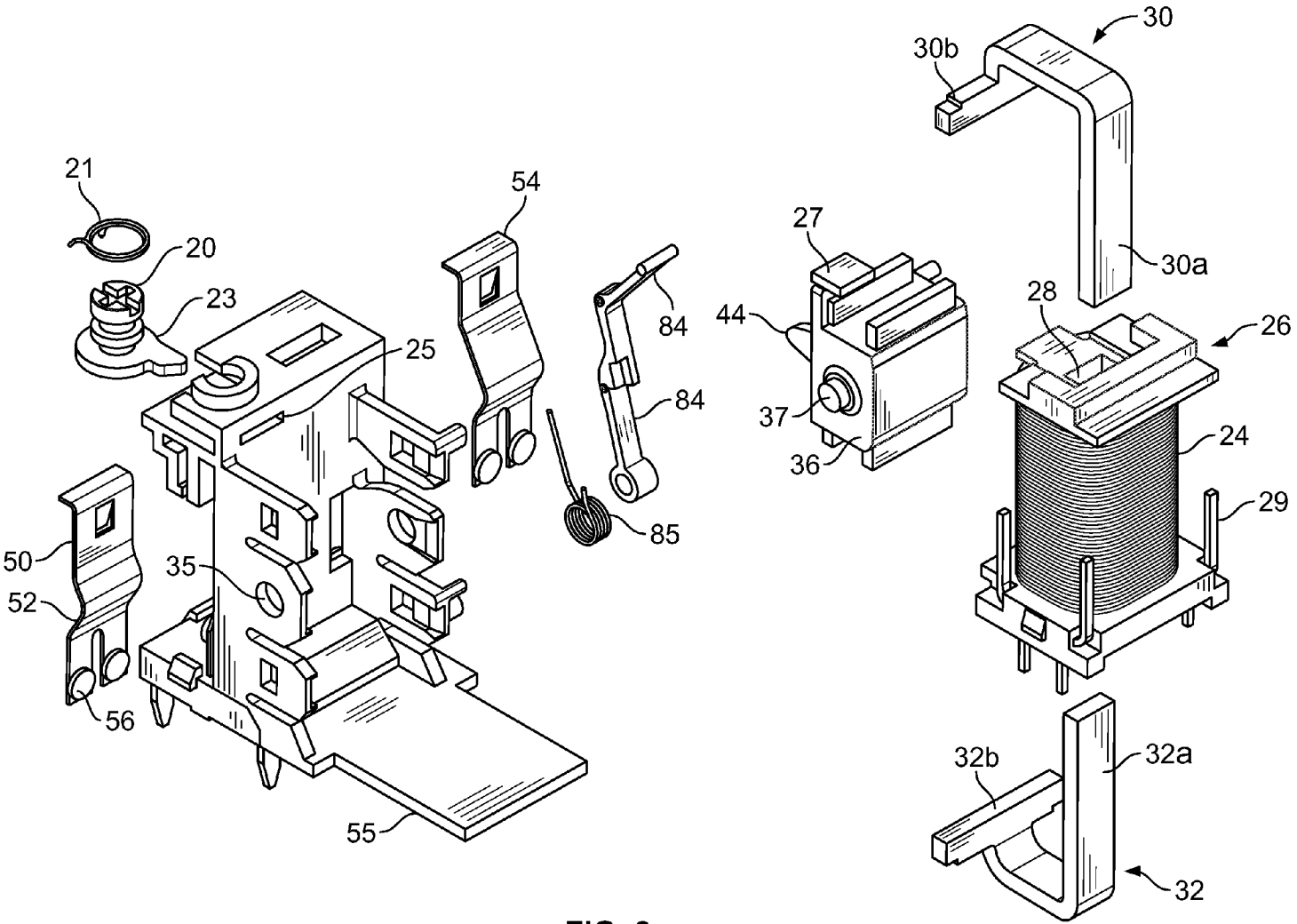
FIG. 3 is an exploded view of the latching relay.

Referring to FIGS. 1-3, one embodiment of a latching relay 10 is shown in accordance with the present invention. The latching relay 10 includes a coil bobbin subassembly 12, a contact arrangement 14 with one or more moveable contacts 18 and a contact lead frame 16. A manual trip element 20 is disposed on the contact arrangement to permit manual override of the relay 10 position.

The coil bobbin subassembly includes two or more separate electromagnetic coils 24 of electrically conductive wire that are concurrently wound around a bobbin 26 with an axial aperture 28. Each of the electromagnetic coils 24 has one or more pairs of terminals 29 extending from the bobbin assembly 26 for connecting the electromagnetic coils 24 to external circuits. A pair of magnetically permeable yoke portions 30, 32 that include leg portions 30*a*, 32*a*, which are disposed within axial aperture 28. Leg portions 30*a*, 32*a* are inserted from opposite ends of aperture 28 and have an abutting interface to form a magnetic circuit with an airgap 34 in which a magnetic pivot armature or actuator 36 is pivotably supported in a main frame 55. The main frame 55 includes an aperture 35 for receiving and supporting a hub portion 37. The hub portion 37 is freely rotatable within the aperture 35.

The pivot armature 36 has a magnet 38 disposed between a pair of magnetically permeable plates 40, 42. A first winding, referred to as the reset coil (not shown) of coil 24 rotates the pivot armature 36 clockwise until the pivot armature plate 40 comes into contact with yoke cross-arms 30*b*, 32*b*, and causes the movable contact springs 50 to return to their normally open or normally closed position, respectively. The second winding, referred to as the trip coil (not shown) of coil 24 rotates the pivot armature counterclockwise until the opposite pivot armature plate 42 comes into contact with the yoke arms 30*b*, 32*b*. The counterclockwise rotation of the pivot armature 36 actuates or trips the moveable contact springs 50. In an alternate embodiment, the pivot arm 36 may be arranged so that the clockwise rotation actuates the relay and the counterclockwise rotation resets the relay.

Actuation of the latching relay 12 occurs when a first cam portion 44 contacts an angular projecting portion 52 of the moveable contact spring 50. A second pair of moveable contact springs 54 is actuated by a second cam portion 46 on the opposite side of the latching relay 10 in a similar manner to that described above, wherein the second cam portion 46 and the corresponding angular projection portion 52 are offset from the moveable contact springs 50 and angular projection portion 52. In the exemplary embodiment moveable contact springs 50 are normally open and moveable contact springs 54 are normally closed, although those skilled in the art will appreciate that the configuration of the contact springs may be reversed or otherwise altered within the scope of the invention.

The moveable contact springs 50 include contact portions 56 that physically engage with contact portions 56 of stationary contacts 60 when the latching relay 10 is actuated for normally open contact springs 50, and when the latching relay 10 is reset for normally closed contact springs 54, as will be explained in greater detail below.

Manual trip element 20 is biased against a return spring and provides a manual override of the relay 10. A cam 23 extends radially from trip element 20 through a slot 25. When the element 20 is rotated, e.g., by a screw driver, cam 23 rotates against a pivot arm 27 on the pivot armature 36, to force the cam portion 44

Figure 4:
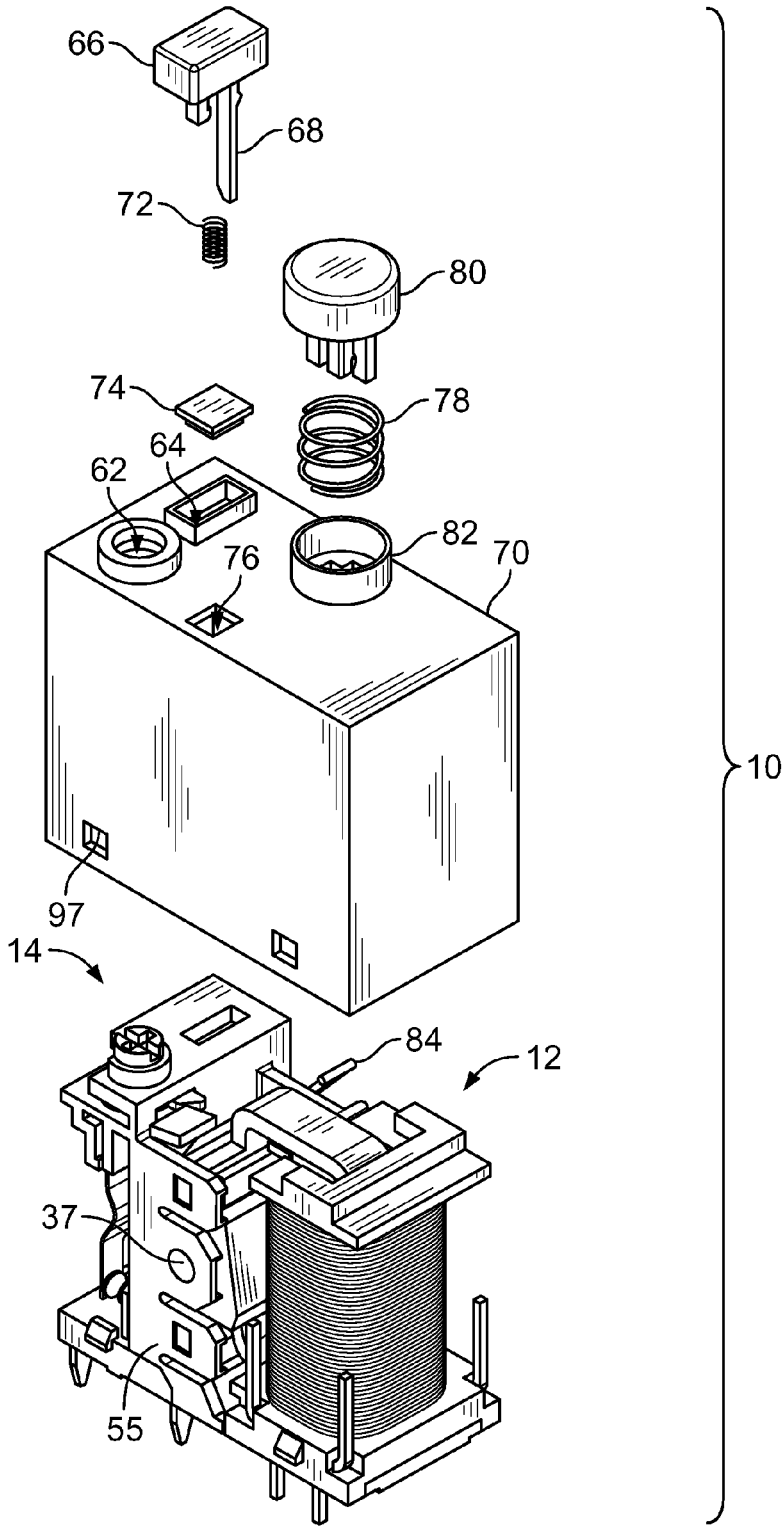
FIG. 4 is an exploded view of the latching relay and cover components.

Referring next to FIG. 4, the latching relay 10 may include a cover portion 70 to enclose the operating parts of the relay 10, and to shield electrically conductive relay components that may present a shock hazard. The cover portion 70 includes an aperture 62 that provides access to the trip element 20 for a tool, e.g., a screwdriver, wrench, knife blade or other tool that is capable of operating the trip element 20. A second aperture 64 is provided in cover portion 70 for receiving a test button 66 with a plunger 68 and return spring 72 for returning the test button 66 to an inactive or normal position. The test button 66 manually trips the relay 10 by urging the pivot arm cams 44 or 46 into the moveable contact springs 50, 54. Also included on the cover portion 70 are a window 74 disposed in aperture 76 for viewing a trip indicator (not shown) located on the pivot armature 36, and a reset button 80, which includes a return spring 78 and is supported in a circular rim 82. The reset button 80, when depressed, acts upon an arm 84 that resets the position of the contact springs 50, 54 to their normally open or normally closed state, respectively. Spring 85 maintains tension on arm 84.

Figure 5:
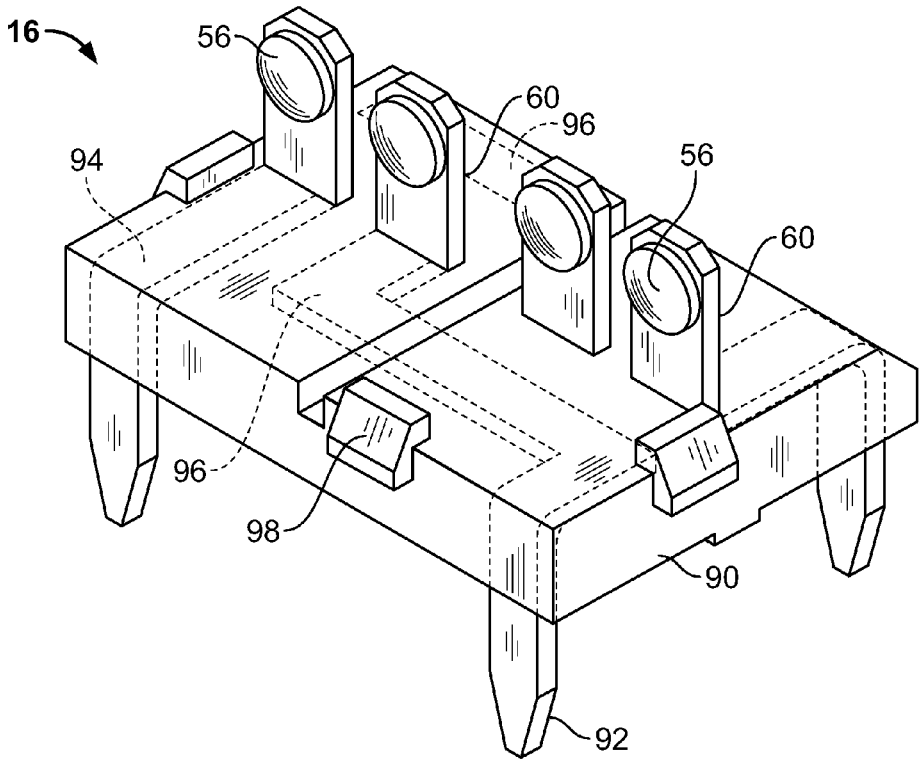
FIG. 5 is a perspective view of the lead frame and stationary contact subassembly.
Figure 6:
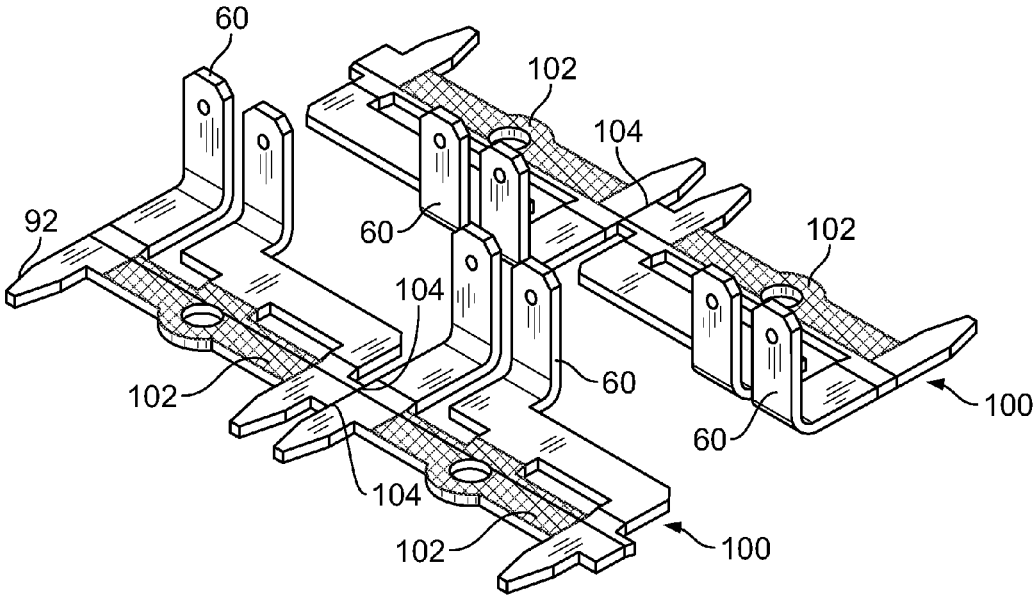
FIG. 6 is a perspective view of a plurality of stationary contacts in a subassembly form before being separated for individual assembly.

Referring next to FIG. 5, the lead frame 16 is shown as a separate component of the latching relay 10. Stationary contacts 60 are overmolded with a dielectric material, e.g., by an injection molding process. The dielectric material may be any suitable elastomeric resin, polymeric or plastic material having the desired combination of properties, e.g., dielectric coefficient, durometer, chemical and mechanical bonding, melting point, and flow characteristics. The overmold portion 90 encapsulates contacts 60 after the contacts 60 are bent into a final configuration to form separate conductive paths 94, 96 (indicated by broken lines) along contacts 60 that extend between contact portions 56 and external posts 92. Conductive paths 94 and 96 are embedded in overmold portion 90. The overmold portion 90 supports the contacts 60, conductive paths 94, 96 and posts 92 in the lead frame 16, to provide consistent minimum spacing and accurate location of the stationary contacts 60 relative to the moveable contact springs 50, 54, and of the external posts relative to a relay socket (not shown). The lead frame 16 includes clip portions 98 spaced about the periphery which correspond with apertures 97 (FIG. 4) of the cover portion 70 to retain the cover portion 70 in position. In one embodiment the lead frame 16 may be attached to the main frame 55 by ultrasonically welding the overmold portion 90 to the main frame 55. Referring to FIG. 6, a pair of contact assemblies 100 is shown with the carrier webbing 102 attached. Carrier webbing 102 is removed prior to overmolding the overmold portion 90 around the stationary contacts 60. The contact assemblies 100 are normally separable at a perforation line 104 to create individual pairs of stationary contacts 60. The perforation lines 104 may be formed by scoring or stamping the assembly 100. Alternately the individual pairs of stationary contacts 60 may be separated from the assembly 100 by laser or by machine cutting methods. It will be appreciated by those skilled in the art that the stationary contacts 60 may be used in a conventional relay, within the scope of the present invention. A conventional relay would simply include a single winding coil on the coil bobbin subassembly 24.

Figure 7:
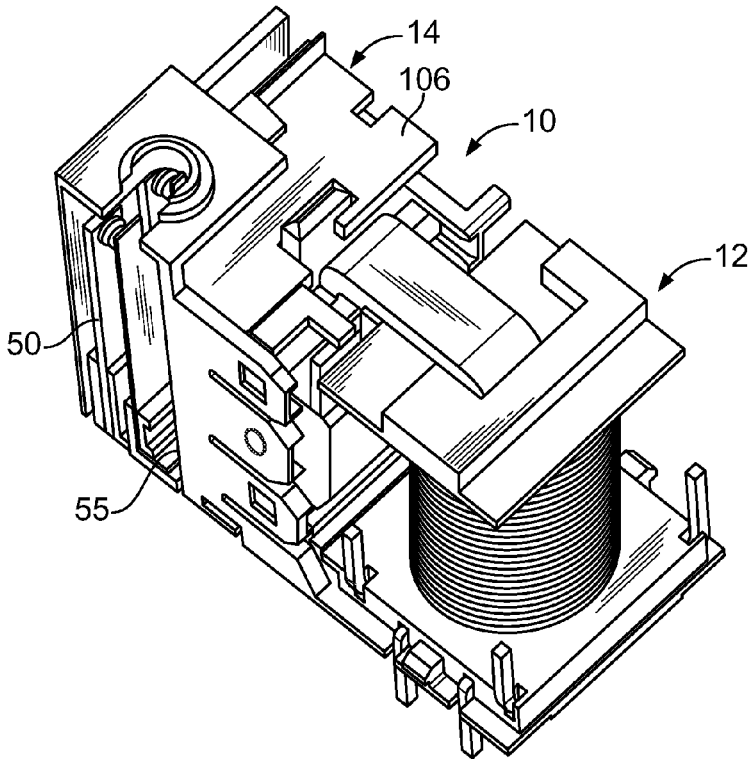
FIG. 7 is a top perspective view of an alternate embodiment of a latching relay.
Figure 8:
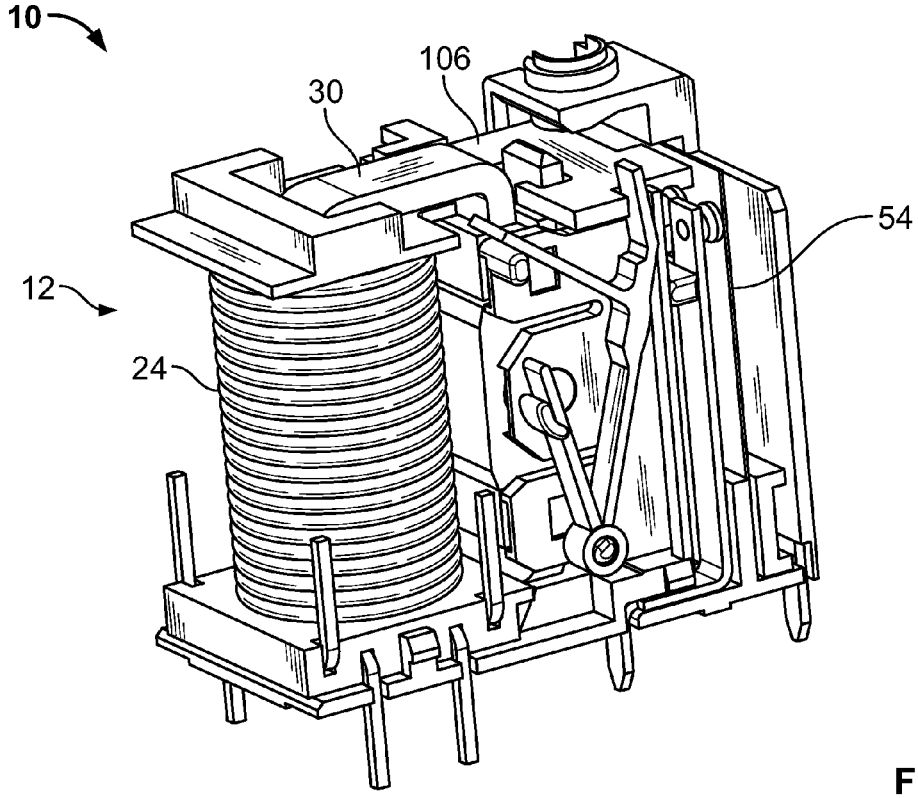
FIG. 8 is a side perspective view of the latching relay of FIG. 8.

Referring to FIGS. 7 and 8, in an alternate embodiment the latching relay 10 may include a pusher portion 106 that provides a mechanical linkage between the pivot armature 36 and the moveable contact springs 50, 54. The pusher portion 106 provides consistent overtravel adjustment of the moveable contact springs 50, 54. The operation of the pusher portion 106 in an electromagnetic relay is described in greater detail in commonly owned U.S. patent application Ser. No. 12/115,638 filed May 6, 2008 entitled Relay With Automated Overtravel Adjustment, which patent application is incorporated by reference herein.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An electromagnetic latching relay comprising:

a relay coil assembly, an armature, and a contact system;

the contact system including at least one stationary contact assembly comprising at least one stationary contact and at least one moveable contact spring adjacent to the at least one stationary contact, the at least one moveable contact spring having a projecting portion wherein the armature pivotably actuated in response to an electromagnetic force generated by the relay coil, to move the at least one contact spring linearly between a first position and a second position;

wherein the at least one stationary contact assembly comprises an overmold portion attached to the at least one stationary contact, the overmold portion comprising a dielectric material and bonded to the at least one stationary contact to maintain a predetermined configuration of the stationary contact relative to the at least one moveable contact spring; and wherein the armature further comprises a first cam portion and a second cam portion, each of the first and second cam portions cooperative with a projecting feature of a corresponding pair of the at least one moveable contact springs to cause the respective contact springs of the projecting feature to switch to one of the first and second state.

2. The electromagnetic latching relay of claim 1, wherein the relay coil assembly includes a first coil of wire and a second coil of wire concurrently wound around a bobbin having an axial aperture, the first coil configured to rotate the armature in a first direction to actuate the contact system in a first position, and the second coil configured to rotate the armature in a second direction to actuates contact system a second state.

3. The electromagnetic latching relay of claim 2, wherein the relay coil assembly further includes a first yoke portion and a second yoke portion, the first and second yokes comprised of a magnetically permeable material, each yoke portion of the first and second yoke portions including a leg portion insertable in the axial aperture opposite ends of the bobbin and have an abutting interface to define a magnetic circuit with the armature.

4. The electromagnetic latching relay of claim 1, in which the armature further comprises a magnet and a pair of magnetically permeable plates, the magnet disposed between the magnetically permeable plates.

5. The electromagnetic latching relay of claim 1, wherein the at least one moveable contact spring comprises a first pair of moveable contact springs and a second pair of moveable contact springs.

6. The electromagnetic latching relay of claim 1, further comprising a detachable cover portion to enclose the relay coil assembly, armature, and contact system.

7. The electromagnetic latching relay of claim 6, wherein the latching relay further comprises a trip element for manually actuating the relay from the first state to the second state, and the cover portion further comprises a first aperture adjacent to the trip element for inserting a tool to actuate the trip element.

8. The electromagnetic latching relay of claim 7, wherein the cover portion further includes a second aperture for receiving a test button of the contact system, the test button further comprising a plunger to actuate the relay to the second state when depressed by the test button, and a return spring configured to return the test button to an inactive or normal position; and wherein the test button manually trips the relay by urging one of the first or second cam portions against the at least one moveable contact springs.

9. The electromagnetic latching relay of claim 6, wherein the cover portion further includes a viewing window for viewing a trip indicator located on the pivot armature.

10. The electromagnetic latching relay of claim 6, further including a reset button having a return spring and being supported in a circular rim portion on the cover portion, wherein the reset button, when depressed acts upon an arm to reset the position of the at least one moveable contact springs to their normally open or normally closed state.

11. The electromagnetic latching relay of claim 1, further including a pusher portion mechanically linked to the pivot armature at a first end and to the at least one moveable contact springs, the pusher portion configured to provide overtravel adjustment of the at least one moveable contact springs.

12. A stationary contact assembly for a relay comprising: at least one stationary contact and an overmold portion attached to the at least one stationary contact, the overmold portion comprising a dielectric material and bonded to the at least one stationary contact to maintain a predetermined configuration of the stationary contact relative to at least one moveable contact spring of the relay; and a plurality of clip portions spaced about the periphery of the overmold portion, the clip portions arranged to correspond with a plurality of apertures of a cover portion to detachably retain the cover portion.

13. The assembly of claim 12, wherein the at least one stationary contact comprises a first contact pair adjacent to a second contact pair, the normally open contact pair electrically isolated from the normally closed contact pair by the overmold portion.

14. The assembly of claim 13, wherein each normally open contact of the normally open contact pair and each normally closed contact of the normally closed contact pair is electrically isolated from the other normally open and normally closed contacts by the overmold portion.

15. The assembly of claim 12, wherein the overmold portion encapsulates the at least one stationary contacts after the at least one stationary contacts are bent into a final configuration to form separate conductive paths along the at least one stationary contacts extending between a contact portion and an external post of each of the at least one stationary contacts.

16. The assembly of claim 12, wherein the at least one stationary contact is formed from a metallic conductive sheet, the conductive sheet having a carrier web portion, and the carrier web portion is removed prior to bonding the overmold portion to the stationary contacts.

17. The assembly of claim 16, wherein the conductive sheet includes one or more perforation lines, a plurality of the at least one stationary contacts separable at the perforation line to create individual pairs of the at least one stationary contacts.

18. The assembly of claim 12, wherein the overmold portion is ultrasonically welded to a frame of the relay.

* * * * *